United States Patent [19]

Agnew

[11] 4,143,714

[45] Mar. 13, 1979

[54] METHOD FOR MONITORING UNDERGROUND FLUID MOVEMENT FOR IMPROVING RECOVERY OF OIL OR BITUMEN

[75] Inventor: George H. Agnew, Calgary, Canada

[73] Assignee: Texaco Exploration Canada Ltd., Canada

[21] Appl. No.: 826,015

[22] Filed: Aug. 19, 1977

[51] Int. Cl.[2] ..... E21B 47/00

[52] U.S. Cl. ..... 166/252; 166/64

[58] Field of Search ..... 166/252, 251, 250, 245, 166/64; 73/155, 151

[56] References Cited

U.S. PATENT DOCUMENTS

| | | | |
|---|---|---|---|
| 2,429,577 | 10/1947 | French, Jr. | 166/250 UX |
| 2,770,305 | 11/1956 | Pirson | 166/251 |
| 2,803,305 | 8/1957 | Behning et al. | 166/251 |
| 3,031,762 | 5/1962 | Parker | 166/251 X |
| 3,292,699 | 12/1966 | Slusser et al. | 166/245 |
| 3,483,730 | 12/1969 | Gilchirst et al. | 166/252 X |
| 3,692,111 | 9/1972 | Breithaupt et al. | 166/252 |

OTHER PUBLICATIONS

American Petroleum Institute, "Secondary Recovery of Oil in the United States" (Second Edition), API, N.Y., N.Y., 1950, pp. 375, 499, 611.

*Primary Examiner*—Stephen J. Novosad
*Attorney, Agent, or Firm*—Carl G. Ries; Thomas H. Whaley; Theron H. Nichols

[57] ABSTRACT

A method for measuring fluid advance in underground formations comprises, (1) driving bench marks into the ground over the formation spaced a predetermined distance apart, (2) measuring and recording the precise vertical displacement of each bench mark at the end of each predetermined period of time, and (3) interconnecting bench marks of similar vertical displacements to form lines, each line indicating the position of the passing of a particular amount of fluid in the formation underground at a particular time.

11 Claims, 5 Drawing Figures

PRIOR TO INJECTION

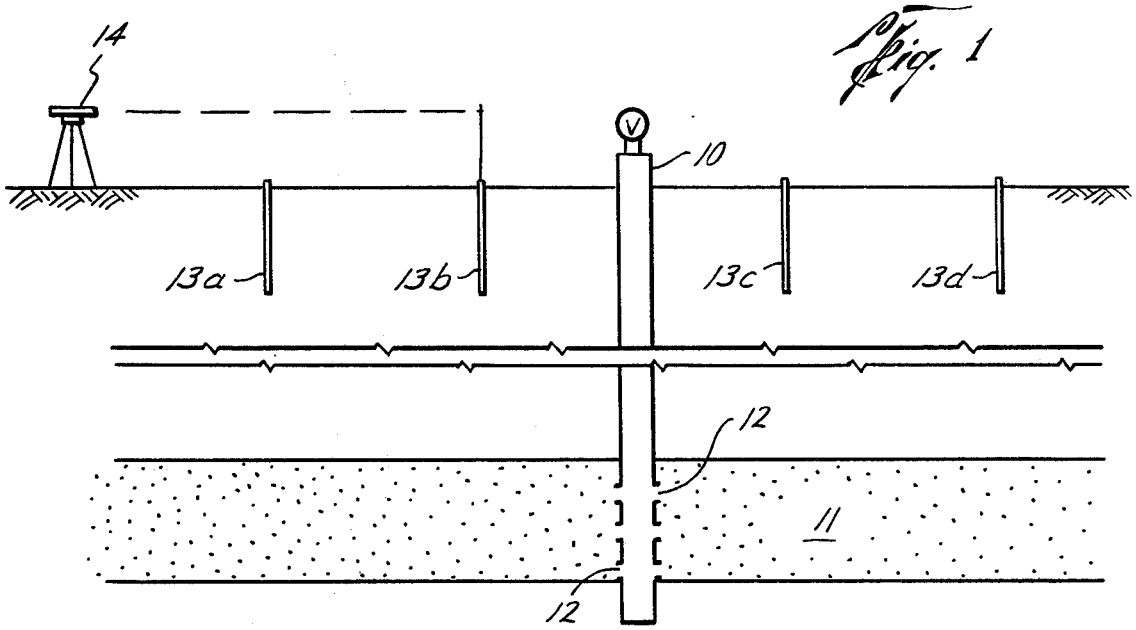
PRIOR TO INJECTION
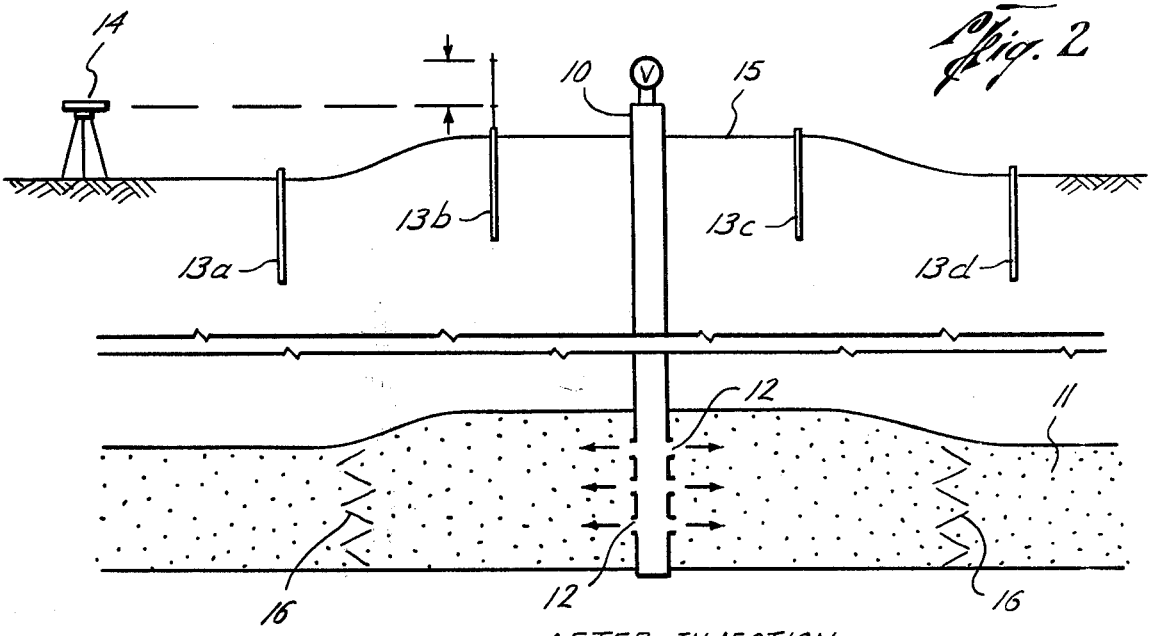
AFTER INJECTION

LEGEND

PRODUCTION WELL ●
INJECTION WELL Ø
BENCH MARK ◐

LEGEND

PRODUCTION WELL ●
INJECTION WELL Ø
BENCH MARK ◐

LEGEND

PRODUCTION WELL ●
INJECTION WELL Ø
BENCH MARK ◐

METHOD FOR MONITORING UNDERGROUND FLUID MOVEMENT FOR IMPROVING RECOVERY OF OIL OR BITUMEN

BACKGROUND OF THE INVENTION

A problem on the subject of recovery of petroleum is the monitoring of the progress or frontal advance of pressurized and/or heated zones during the injection of steam, air, water, or other fluids into oil bearing or bituminous reservoirs. The recovery of heavy oils or bitumen is desired particularly from large, shallow deposits such as one of the Athabasca oil sand deposits in Alberta, Canada. The availability of a simple means to locate the advancing front of injected fluids would aid in the evaluation and improvement of experimental recovery processes and would assist optimizing commercial applications.

OBJECTS OF THE INVENTION

A primary object of this invention is to provide a method for monitoring underground fluid movement for improving recovery of oil or bitumen from relatively shallow oil bearing reservoirs.

Another primary object of this invention is to provide a method for measuring fluid advance in underground formations by measuring and recording the precise vertical displacement of bench marks in the ground at the end of predetermined periods of time for indicating the position of the passing of a particular amount of fluid in the formation underground at a particular time.

A further object of this invention is to provide a method for determining when to reduce or increase the rate of steam injection in injections wells.

A still further object of this invention is to provide a method for determining when to change the production rate in a well to bring the swept area to a more symmetrical shape.

Another object of this invention is to provide a means to locate sites for producing wells by first commencing injection of fluid into injection wells and then drilling producing wells at locations indicated from the monitoring results to have favorable flow conditions or conversely by avoiding drilling producing wells at sites indicated to have unfavorable flow conditions.

A further object of this invention is to provide a method for monitoring fluid movement in a particular underground formation for flowing with any other fluids in the formation that is easy to operate, is economical to carry out the steps, and is of greater efficiency for the recovery of petroleum.

Other objects and various advantages of the disclosed method for measuring fluid advance in underground formations will be apparent from the following detailed description, together with the accompanying drawings, submitted for purposes of illustration only and not intended to define the scope of the invention, reference being made for that purpose to the subjoined claims.

BRIEF DESCRIPTION OF THE DRAWINGS

The drawings diagrammatically illustrate by way of example, not by way of limitation, one form for carrying out the method of the invention wherein like reference numerals designate corresponding parts in the several views in which:

FIG. 1 is a schematic vertical section of the earth including an injection well extending down to the subsurface petroleum containing formation, and a few bench marks driven in the ground surface;

FIG. 2 is a view similar to FIG. 1 showing the bench marks after injection of fluids from the injection well;

Figure 3:
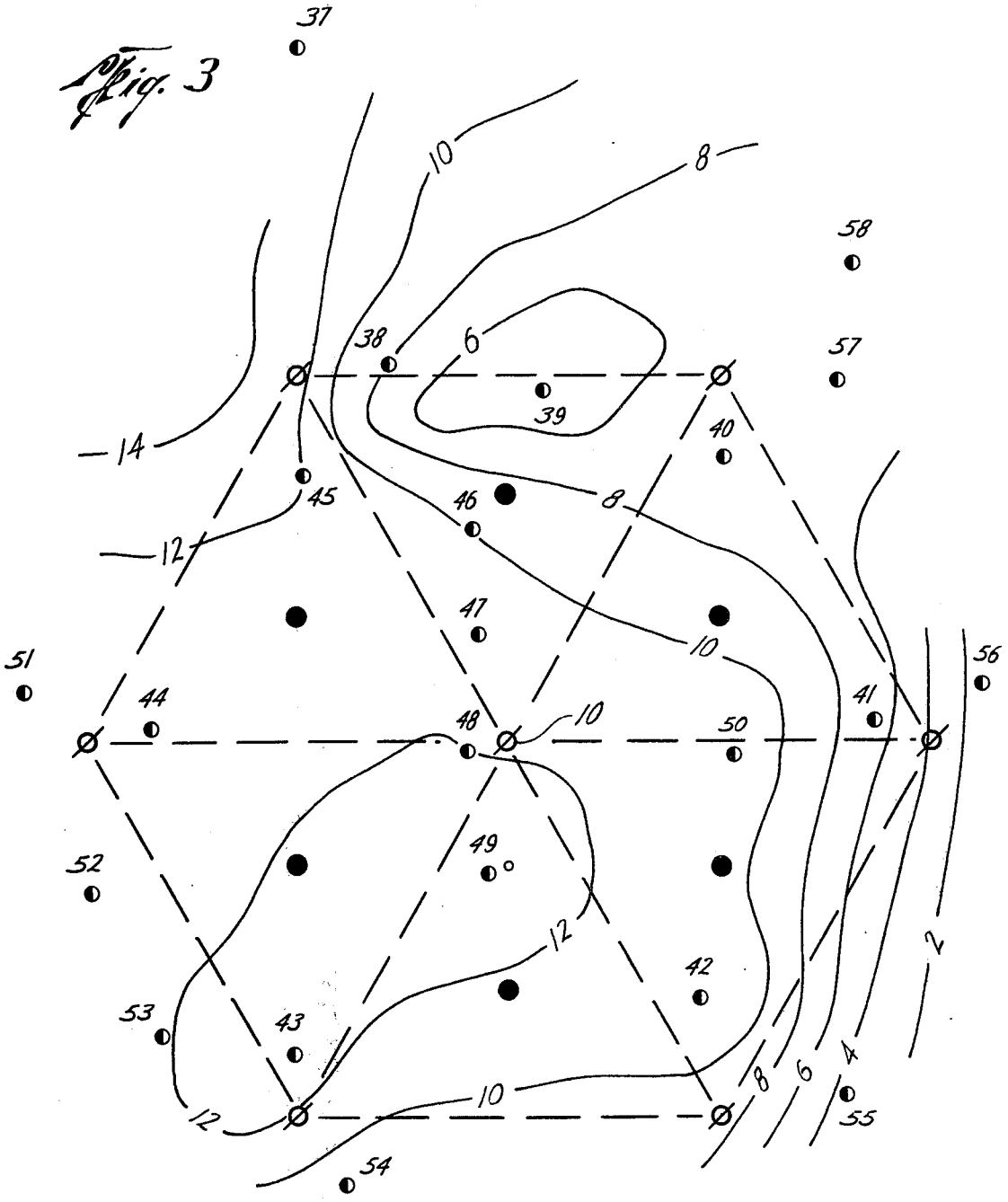
FIG. 3 is a contoured survey of the incremental elevation changes in an Athabasca field from May 12, 1976 to Sept. 1, 1976.

The invention disclosed herein, the scope of which being defined in the appended claims, is not limited in its application to the details of construction and arrangement of parts shown and described for carrying out the disclosed method, since the invention is capable of other embodiments for carrying out other methods and of being practiced or carried out in various other ways. Also, it is to be understood that the phraseology or terminology employed herein is for the purpose of description and not of limitation. Further, many modifications and variations of the invention as hereinbefore set forth will occur to those skilled in the art. Therefore, all such modifications and variations which are within the spirit and scope of the invention herein are included and only such limitations should be imposed as are indicated in the appended claims.

DESCRIPTION OF THE INVENTION

This invention comprises a method for monitoring and measuring fluid advance in formations underground for improving recovery of oil or bitumen from relatively shallow oil bearing or bituminous reservoirs.

FIG. 1, a vertical sectional view of the earth, illustrates an injection well 10 extending down to a geologic formation, preferably a petroliferous formation 11. Injection well 10 has perforations 12 therein the portion of the casing in the formation. Conventional representative bench marks 13*a*, 13*b*, 13*c*, and 13*d* are shown driven in the ground and spaced a predetermined distance apart. A transit 14 is set up for taking sightings on all bench marks for recording the elevation of each over the desired periods of time.

Locating the advancing front of injected fluids aids in the evaluation and improvement of oil recovery processes and assists optimizing commercial applications. The amount by which the surface is raised should be generally proportional or otherwise related to the degree of pressurization or heating, and can be calculated by one skilled in the art.

FIG. 2, a schematic vertical section of the earth after the injected fluids have begun to flow from the perforations 12 in the injection well 10 into the formation 11, shows the rise 15 in the ground surface in exaggerated form indicating the passing of a particular amount of oil displacing fluid 16 underground at a particular time. The rise of the surface is due to the expansion of the formation due to increased pressure and/or heat caused by the flow of the particular fluid, whether it be steam, air, water, or other fluids in the relatively shallow oil bearing or bituminous reservoirs, as the Athabasca oil sand deposits in Alberta, Canada.

Figure 4:
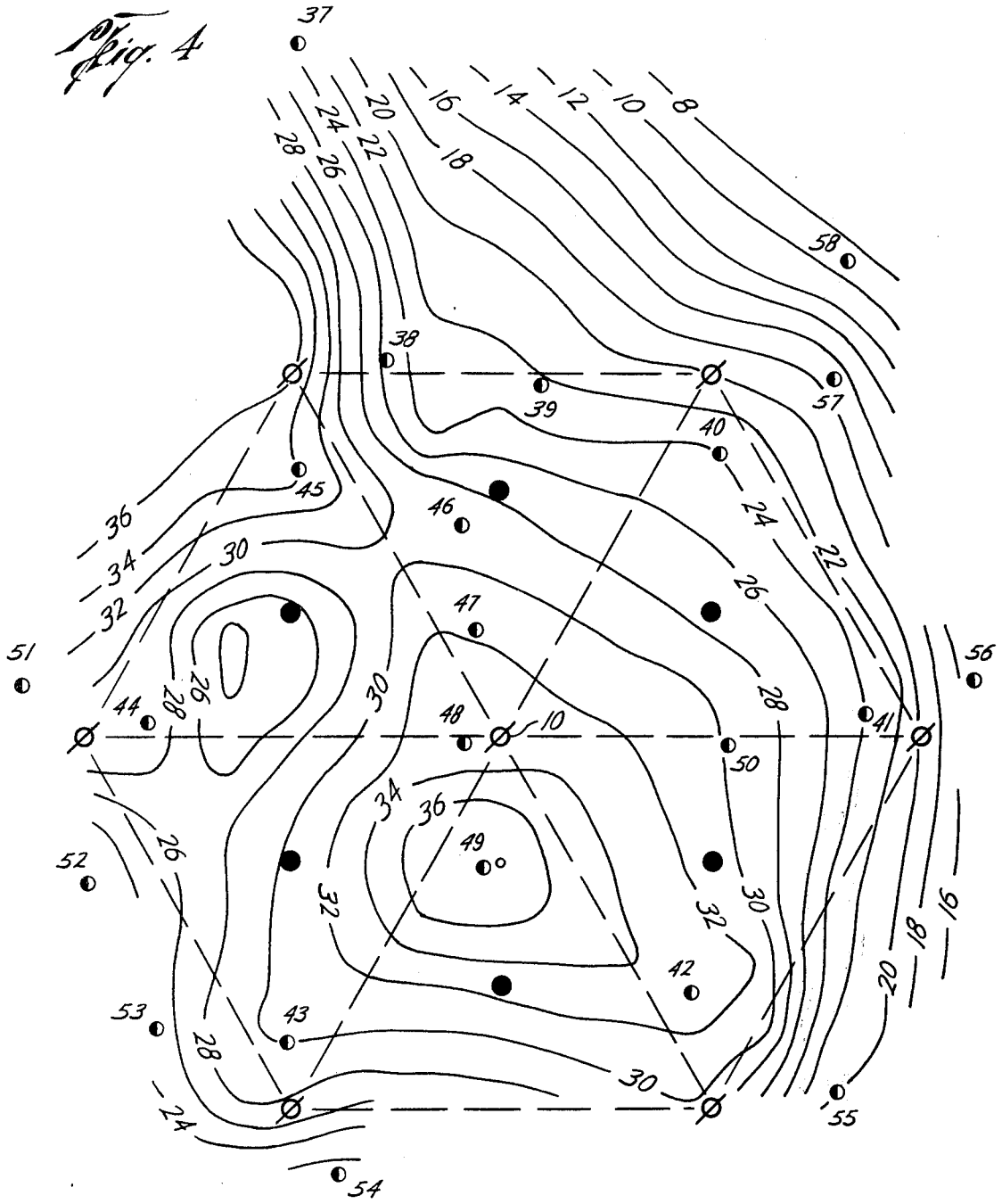
FIG. 4 is a contoured survey of the incremental elevation changes of the oil field of FIG. 3 from May 12, 1976 to May 24, 1976.
Figure 5:
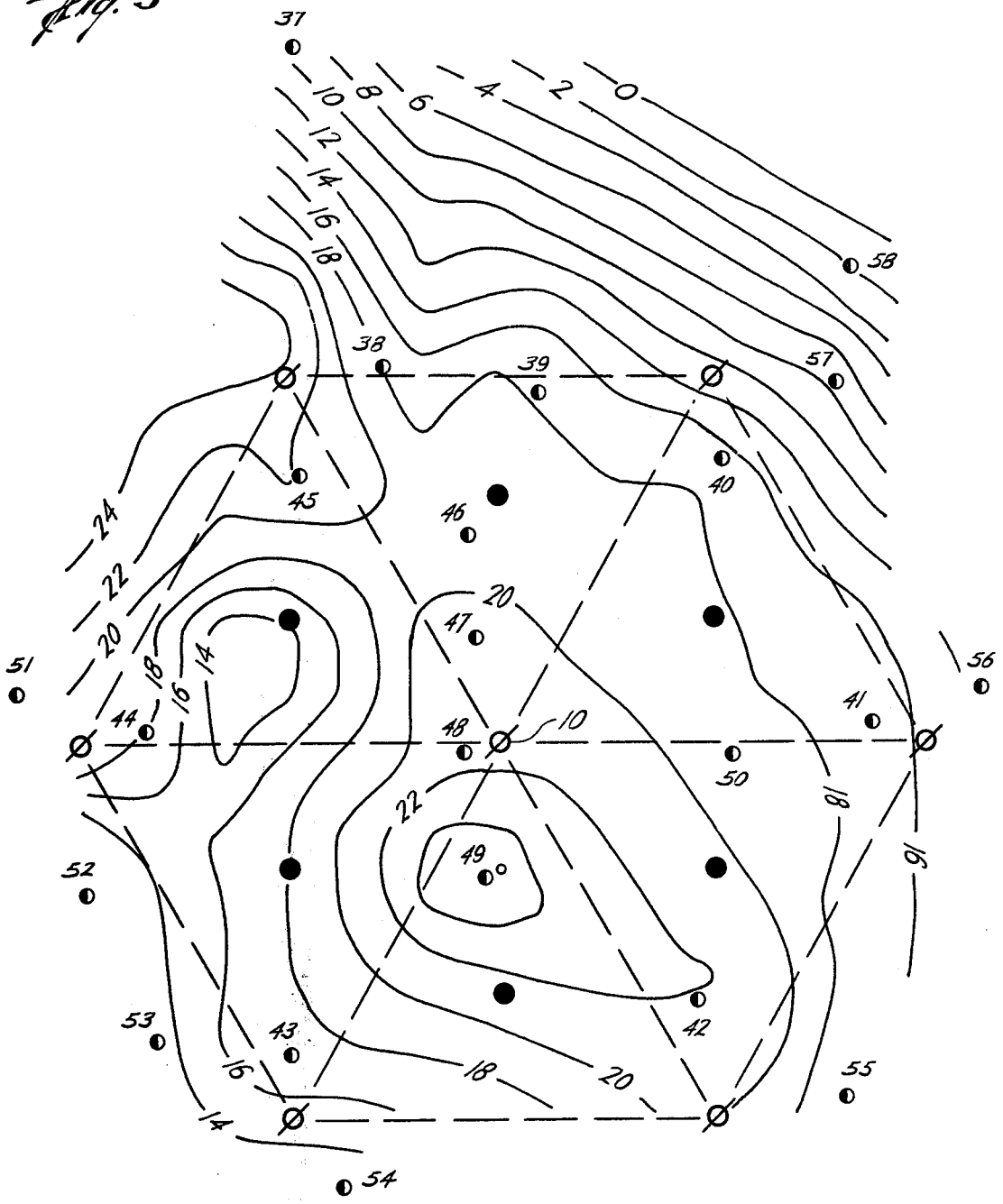
FIG. 5 is a contoured survey of the incremental elevation changes of the oil field of FIG. 3 from Sept. 1, 1976 to Nov. 24, 1976.

Thus in operation of the invention for monitoring the underground fluid movement under a particular area of ground at the end of predetermined periods of time, the steps involved are:

(1) Bench marks 13a–13d, FIG. 1, are driven or positioned in the ground over the area spaced a predetermined distance apart, a few of which are illustrated in FIGS. 3–5.

(2) A transit, or the like 14, is set up for measuring and recording the precise elevation of each bench mark at the beginning and end of each predetermined period of time, the difference between the two recordings being the vertical displacement at the end of each predetermined period of time as the fluid is flowing underground.

(3) The bench marks of similar vertical displacement are interconnected to form lines whereby each line indicates the position of the passing of a particular amount of fluid underground at a particular time.

(4) Or expressing it differently, the lines may be drawn to connect like points, each point of which having the same total vertical displacement as the other connected point or bench mark over a precise period of time.

Other methods may also be used to establish the change in ground elevation, such as precise photogrammetric interpretation of suitable aerial photographs.

Various other data may be obtained from the above measuring and recording of the precise vertical displacement of each bench mark at the end of each predetermined period of time.

The Table I below shows a recent sampling of the incremental elevation changes which are plotted on FIGS. 3, 4, and 5. At Station 1, for example, an elevation reading was taken on May 12, 1976, of 1,268.35 feet above sea level and again on Sept. 1, 1976. The difference in these two readings was calculated and listed as "0.16" of a foot under the column for "FIG. 3". A third reading was taken on Nov. 24, 1976, of 1,268.63 feet, the increase over the first or May 12, 1976 reading noted, and the increase recorded as "0.28" of a foot in the column under "FIG. 4". Then the amount of increase of a Nov. 24, 1976 reading over the Sept. 1, 1976 reading was noted and recorded as "0.12" of a foot under the column headed by "FIG. 5". As long as the readings increased with time, they were recorded as positive. If a later reading was less than an earlier reading, the difference was recorded as negative, as "−0.02" at Station 29 in the column for "FIG. 5". The rest of the readings in the Table are shown for only the first 62 Stations for forming the curves of FIGS. 3, 4, and 5.

TABLE I

| | | INCREMENTAL ELEVATION CHANGES | | | | |
|---|---|---|---|---|---|---|
| Station | Elevation 5/12/76 (ft. ASL) | Elevation 9/1/76 (ft. ASL) | Elevation 11/24/76 (ft. ASL) | FIG. 3 5/12/76–9/1/76 | FIG. 4 5/12/76–11/24/76 | FIG. 5 9/1/76–11/24/76 |
| 1 | 1268.35 | 1268.51 | 1268.63 | .16 | .28 | .12 |
| 2 | 1267.42 | 1267.64 | 1267.83 | .22 | .41 | .19 |
| 3 | 1266.83 | 1267.07 | 1267.16 | .24 | .33 | .09 |
| 4 | 1266.69 | 1266.92 | 1267.01 | .23 | .32 | .09 |
| 5 | 1267.43 | 1267.66 | 1267.84 | .23 | .41 | .18 |
| 6 | 1262.97 | 1263.18 | 1263.20 | .21 | .23 | .02 |
| 7 | 1262.33 | 1262.54 | 1262.56 | .21 | .23 | .02 |
| 8 | 1265.10 | 1265.28 | 1265.33 | .18 | .23 | .05 |
| 9 | 1265.75 | 1265.97 | 1265.12 | .22 | .37 | .15 |
| 10 | 1266.90 | 1267.14 | 1267.26 | .24 | .36 | .12 |
| 12 | 1265.17 | 1265.30 | 1265.41 | .13 | .24 | .11 |
| 13 | 1265.14 | 1265.26 | 1265.37 | .12 | .23 | .11 |
| 14 | 1264.50 | 1264.61 | 1264.73 | .11 | .23 | .12 |
| 15 | 1265.48 | 1265.71 | 1265.72 | .23 | .24 | .01 |
| 16 | 1265.46 | 1264.61 | 1264.72 | .15 | .26 | .11 |
| 17 | 1264.43 | 1264.57 | 1264.68 | .14 | .25 | .11 |
| 18 | 1268.60 | 1268.82 | 1269.00 | .22 | .40 | .18 |
| 19 | 1267.48 | 1267.64 | 1267.77 | .16 | .29 | .13 |
| 20 | 1265.35 | 1265.40 | 1265.55 | .05 | .20 | .15 |
| 21 | 1265.55 | 1265.60 | 1265.71 | .05 | .16 | .11 |
| 22 | 1264.91 | 1265.06 | 1265.11 | .15 | .20 | .05 |
| 23 | 1266.52 | 1266.70 | 1266.81 | .18 | .29 | .11 |
| 24 | 1264.31 | 1264.52 | 1264.67 | .21 | .36 | .15 |
| 25 | 1267.65 | 1267.71 | 1267.82 | .06 | .17 | .11 |
| 26 | 1267.81 | 1267.99 | 1268.08 | .18 | .27 | .09 |
| 27 | 1267.55 | 1267.74 | 1267.83 | .19 | .28 | .09 |
| 28 | 1266.08 | 1266.29 | 1266.39 | .21 | .31 | .10 |
| 29 | 1258.85 | 1258.99 | 1258.97 | .14 | .12 | −.02 |
| 30 | 1269.66 | 1269.91 | 1270.02 | .25 | .36 | .11 |
| 31 | 1266.98 | 1267.13 | 1267.20 | .15 | .22 | .07 |
| 32 | 1263.96 | 1264.08 | 1264.09 | .12 | .13 | .01 |
| 33 | 1263.49 | 1263.61 | 1263.62 | .12 | .13 | .01 |
| 34 | 1263.97 | 1264.09 | 1264.09 | .12 | .12 | .00 |
| 35 | 1272.81 | 1272.93 | 1273.15 | .12 | .34 | .22 |
| 36 | 1272.91 | 1273.00 | 1273.16 | .09 | .25 | .16 |
| 37 | 1267.15 | 1267.29 | 1267.40 | .14 | .25 | .11 |
| 38 | 1271.35 | 1271.42 | 1271.60 | .07 | .25 | .18 |
| 39 | 1270.72 | 1270.77 | 1270.95 | .05 | .23 | .18 |
| 40 | 1270.71 | 1270.78 | 1270.95 | .07 | .24 | .17 |
| 41 | 1273.11 | 1273.18 | 1273.35 | .07 | .24 | .17 |
| 42 | 1270.76 | 1270.87 | 1271.09 | .11 | .33 | .22 |
| 43 | 1270.46 | 1270.59 | 1270.76 | .13 | .30 | .17 |
| 44 | 1269.81 | 1269.92 | 1270.10 | .11 | .29 | .18 |
| 45 | 1271.09 | 1271.21 | 1271.43 | .12 | .34 | .22 |
| 46 | 1270.65 | 1270.75 | 1270.94 | .10 | .29 | .19 |
| 47 | 1271.03 | 1271.14 | 1271.35 | .11 | .32 | .21 |
| 48 | 1272.86 | 1272.98 | 1273.19 | .12 | .33 | .21 |
| 49 | 1273.11 | 1273.24 | 1273.49 | .13 | .38 | .25 |
| 50 | 1270.90 | 1271.01 | 1271.20 | .11 | .30 | .19 |
| 51 | 1266.83 | 1266.94 | 1267.07 | .11 | .24 | .13 |
| 52 | 1266.09 | 1266.20 | 1266.32 | .11 | .23 | .12 |
| 53 | 1267.12 | 1267.23 | 1267.34 | .11 | .22 | .11 |
| 54 | 1267.99 | 1268.08 | 1268.21 | .09 | .22 | .13 |
| 55 | 1268.34 | 1268.38 | 1268.55 | .04 | .21 | .17 |
| 56 | 1268.83 | 1268.85 | 1268.99 | .02 | .16 | .14 |

TABLE I-continued

| Station | Elevation 5/12/76 (ft. ASL) | Elevation 9/1/76 (ft. ASL) | Elevation 11/24/76 (ft. ASL) | INCREMENTAL ELEVATION CHANGES FIG. 3 5/12/76–9/1/76 | FIG. 4 5/12/76–11/24/76 | FIG. 5 9/1/76–11/24/76 |
|---|---|---|---|---|---|---|
| 57 | 1266.99 | 1267.07 | 1267.17 | .08 | .18 | .10 |
| 58 | 1264.71 | 1264.78 | 1264.81 | .07 | .10 | .03 |
| 59 | 1268.54 | 1268.78 | 1268.96 | .24 | .42 | .18 |
| 60 | 1268.13 | 1268.38 | 1268.56 | .25 | .43 | .18 |
| 61 | 1267.88 | 1268.11 | 1268.26 | .23 | .38 | .15 |
| 62 | 1269.19 | 1269.37 | 1269.52 | .18 | .33 | .15 |

FIG. 3 is a plan view of a test well pattern in the Athabasca oil sand deposit in Alberta, Canada showing incremental elevation changes in hundredths of feet for the area, about 3.75 acres (1.5 hectares), taken from column 5 of Table I from May 12, 1976 to Sept. 1, 1976. The injector well 10, which is in the center of the area, has an identifiable point located at an elevation of 1270.62 feet above sea level. While the contour lines ordinarily may interconnect bench marks of like or equal elevations, the FIG. 3 contour lines are novel and more valuable in that they show the amount of change in elevation during a precise time period, as the time period identified above, and which incremental elevations are recorded in the second column of the Table.

FIG. 4 is a plan view of the area of FIG. 3 showing contour lines interconnecting bench marks of similar vertical displacement during the time period from May 12, 1976 to Nov. 24, 1976 as recorded in the sixth column of the Table in hundredths of a foot.

FIG. 5 is a plan view of the area of FIG. 3 showing contour lines interconnecting bench marks of a similar vertical displacement for the time period from Sept. 1, 1976 to Nov. 24, 1976, as recorded in the seventh column of the Table in hundredths of a foot.

ADVANTAGES

From these contour lines it may be determined when to reduce or increase the rate of steam injection in the injection well or wells.

Also, it may be determined from those contour lines when to change the production rate in a producing well to bring the swept area to a more symmetrical shape.

Obviously other methods may be utilized for monitoring underground fluid movement with the embodiments of FIG. 1 and FIG. 2 than those listed above.

Accordingly, it will be seen that while embodiments of FIGS. 1 or 2 operate in a manner which meets each of the objects set forth hereinbefore.

While only one method of the invention and one group of bench marks and a transit for carrying out the method have been disclosed, it will be evident that various other methods and modifications are possible without departing from the scope of the invention and it is accordingly desired to comprehend within the purview of this invention such modifications as may be considered to fall within the scope of the appended claims.

I claim:

1. A method for monitoring underground fluid movement under a particular surface area of ground at the end of predetermined periods of time comprising the steps of, (a) positioning bench marks on the ground over the area spaced a predetermined distance apart, (b) measuring and recording the precise vertical displacement of each bench mark at the end of each predetermined period of time as the fluid is flowing underground, (c) interconnecting bench marks of similar vertical displacements to form curved lines for forming a contour map of the particular surface area, and (d) forming each curved line to indicate a particular and different amount of vertical displacement of the ground relative to each particular and different amount of fluid passing underground at a particular and different time.

2. A method for monitoring underground fluid movement under a particular surface area of ground at the end of predetermined periods of time comprising the steps of, (a) positioning bench marks on the ground over the area spaced a predetermined distance apart, (b) injecting a fluid underground for flowing with any liquids therein toward and under the bench marks, (c) measuring and recording the precise vertical displacement of each bench mark at the end of each predetermined period of time as the fluid is flowing underground, (d) interconnecting bench marks of similar vertical displacements to form curved lines for forming a contour map of the particular surface area, and (e) forming each curved line to indicate a particular and different amount of rise of the ground relative to each particular and different amount of fluid passing underground at a particular and different time.

3. A method as recited in claim 2 wherein the second step comprises, (a) injecting a gas underground for flowing with any liquids therein toward and under the bench marks.

4. A method as recited in claim 2 wherein the second step comprises, (a) injecting an oil displacing fluid underground for flowing with any liquids therein toward and under the bench marks.

5. A method for monitoring fluid movement in a particular formation underground at the end of predetermined periods of time comprising the steps of, (a) positioning a plurality of bench marks on the ground over the particular formation spaced a predetermined distance apart, (b) injecting a fluid underground into the particular underground formation for flowing with any other fluids in the formation toward and under the bench marks, (c) measuring and recording the precise vertical displacement of each bench mark at the end of each predetermined period of time, (d) interconnecting bench marks of similar vertical displacements to form curved lines for forming a contour map of the surface area over the particular formation, and (e) forming each curved line to indicate a particular and different amount of rise of the ground relative to each particular and different amount of fluid passing in the formation underground at a particular and different time.

6. A method as recited in claim 5 wherein the second method step comprises, (a) injecting an oil displacing fluid into the particular formation underground for flowing with any fluids in the formation toward and under the bench marks.

7. A method as recited in claim 5 wherein the second method step comprises, (a) injecting an oil recovery fluid into the particular formation underground for flowing with any fluids in the formation toward and under the bench marks.

8. A method for monitoring underground fluid movement under a particular surface area of ground at the end of predetermined periods of time comprising the steps of, (a) positioning bench marks on the ground over the area spaced a predetermined distance apart, (b) measuring and recording the precise distance each bench mark has raised at the end of each predetermined period of time as the fluid is flowing underground, (c) interconnecting bench marks of similar distances raised to form curved lines for forming a contour map of the particular surface area, and (d) forming each curved line to indicate a particular and different amount of rise of the ground relative to each particular and different volume of fluid passing underground at a particular and different time.

9. A method for monitoring underground fluid movement under a particular surface area of ground at the end of predetermined periods of time comprising the steps of, (a) determining points on the ground over the area spaced a predetermined distance apart, (b) interconnecting points of similar changes in ground elevation to form curved lines for forming a contour map of the particular surface area, and (c) forming each curved line to indicate a particular and different amount of rise of the ground relative to each particular and different volume of fluid passing underground at a particular and different time.

10. A method as recited in claim 9 including the additional step of, (a) detecting further movement of underground fluid movement by comparing a contour map of vertical displacements for the particular area of ground for one period of time (FIG. 3) with a contour map of vertical displacements for the same particular area of ground for another period of time (FIG. 4).

11. A method for monitoring underground fluid movement under a particular area of ground at the end of predetermined periods of time comprising the steps of, (a) taking aerial photographs of the area, (b) determining points on the ground over the area spaced a predetermined distance apart by (c) establishing the change in ground elevation at the points by precise photogrammetric interpretation of the aerial photographs, and (d) interconnecting points of similar changes in ground elevation to form lines, each line indicating the position of the passing of a particular volume of fluid underground at a particular time.

* * * * *